United States Patent [19]

Hanneken

[11] Patent Number: 4,462,572

[45] Date of Patent: Jul. 31, 1984

[54] FENCE STAY

[76] Inventor: Robert L. Hanneken, Rte. 1, Box 110, Verona, Mo. 65769

[21] Appl. No.: 413,818

[22] Filed: Sep. 1, 1982

[51] Int. Cl.[3] ..... B21F 27/00

[52] U.S. Cl. ..... 256/52; 256/49

[58] Field of Search ..... 256/34, 52, 10, 58, 256/53, 56, 32, DIG. 5, 49

[56] References Cited

U.S. PATENT DOCUMENTS

| | | | |
|---|---|---|---|
| 533,959 | 1/1895 | Leffler | 256/52 |
| 565,966 | 8/1896 | Deck | 256/32 X |
| 732,242 | 6/1903 | Wait | 256/52 |
| 2,821,365 | 1/1958 | Lach | 256/10 X |
| 3,776,522 | 12/1973 | Bartlett | 256/50 X |

FOREIGN PATENT DOCUMENTS

| | | | |
|---|---|---|---|
| 28581 | 8/1930 | Australia | 256/52 |
| 10486 | 12/1905 | United Kingdom | 256/52 |

*Primary Examiner*—Andrew V. Kundrat

*Attorney, Agent, or Firm*—Harvey B. Jacobson

[57] ABSTRACT

A fence stay for use in fixedly spacing strands of wire fencing between posts including smooth, barbed and woven wire strands strung between the posts. The stay includes an elongated strip of rigid sheet material arcuately or angularly contoured about a longitudinal axis thereof, a series of transversely arranged slots spaced along the length of the axis of the sheet material for receiving separate strands of the fencing wire, and a locking wire adapted to be slid in parallel to the axis between and into an interior surface of the strip and the strands of wire passing through the series of slots. The locking wire has a hook on the upper end and after installation, the lower end is crimped upwardly around the bottom edge of the strip. The sheet material forming the strip includes rolled edges for adding rigidity to the fence stay. Reflective coatings may be applied to the exterior contour of the fence stay or added to the plastic material when the stay is formed thereby providing for increased awareness of the presence of the fence stay.

9 Claims, 5 Drawing Figures

FENCE STAY

BACKGROUND OF THE INVENTION

1. Field of the Invention

The present invention relates to a fence stay constructed of contoured sheet material cooperating with a stay lock element for retaining wire strands of fencing in a desired spaced relation between the supporting posts for livestock or security fencing. The fence stays are not intended to reach the ground between the posts and are suspended with the strands of wire, being lightweight in nature and holding the wire strands in desired spaced relation due to the wire strands being placed in a spaced slot in the material and retained in locked relation by a stay lock member. More particuarly, the invention is directed to a lightweight, strong and easily installed fence stay in which exterior surfaces of the fence stay may have a reflective coating so that it is easier seen by men and animals than other stays used in the past thereby resulting in a safer fence. The fence stays made from sheetmetal with a coating would withstand weather damage in sunbelt parts of the country while the fence stay may alternatively be made from sheet plastic and withstand high rainfall in other parts of the country. The fence stay when made from sheet plastic can be used to separate the insulated strands in an electric fence from the non-insulated wire strands.

2. Description of the Prior Art

Various U.S. patents are known which are cited as follows: U.S. Pat. No. 565,966, M. T. Deck U.S. Pat. No. 601,671, M. Neil et al U.S. Pat. No. 613,078, R. B. Robbins U.S. Pat. No. 631,272, T. G. Bonta The patent to Deck discloses a fence stay having wire receiving openings and a locking rod having bent over ends that prevent fence wires from leaving the respective openings. None of these patents discloses in combination all of the specifics of the present invention in such a way as to bear upon the patentability of any claim of the present invention.

SUMMARY OF THE INVENTION

In some parts of the country, barbed wire fences are built by installing posts in the ground quite some distance apart and then stringing four or five separate strands of barbed wire between the posts. In between the post are several fence stays, a device that maintains the four or five strands of barbed wire in a properly spaced relation and yet does not require the expense of placing and installing posts at more frequent intervals.

An object of the present invention is to provide improved structural features of fence stays including construction of the stay from sheet material with a reflective surface for improving the awareness of the fence stay by both man and animals.

Another important object of the present invention is to provide a fence stay constructed from an elongated lightweight sheet of either metal or plastic with contoured slots along an intermediate portion of a longitudinal axis thereof, inserting strands of wire in selected ones of the slots, and locking them in place by means of a lock member of wire material interposed between an interior surface of the stay adjacent the slots and the strands passing through the slots. The slots may be spaced every two inches apart and the like, and it is easy to place wires within the selected slots at desired spacings accordingly. Less time is consumed to install the fence stay than the more conventional types of fence stays used in the past. The fence stays of the present invention are provided with an exterior reflective coating that is easily seen by man and animals than the stays of the prior art thus resulting in a safer fence assembly.

A further object of the present invention is to provide improvded livestock or security fencing in which fence stays of the invention are used to maintain strands of wire in desired spaced relation between permanent and upright structural posts. Fence stays are not intended to reach the ground between the posts but, being of rather lightweight material, are suspended with the strands of wire between the posts for holding the wires in desired fixed space relation. The fence stay of the present invention provides for ease in fence construction of rebuilding of fence structures. The fence stays provide for locking the fence wires in place by inserting a lock member along an interior surface of the stay and between the stay and the wires of the fence so that by crimping the ends of the lock, the lock member cannot be easily removed.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
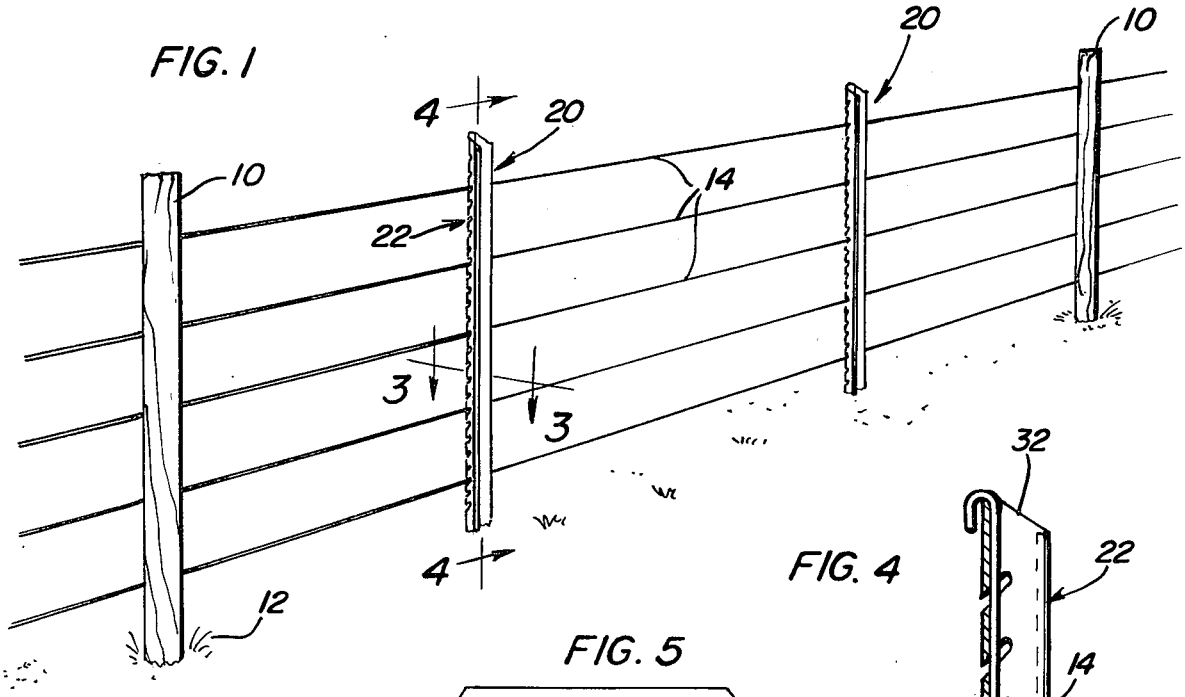
FIG. 1 is a perspective view of a fence including the fence stay according to the present invention.
Figure 2:
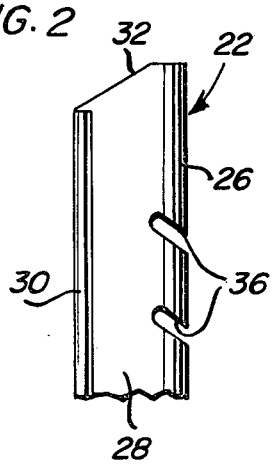
FIG. 2 is an enlarged fragmental side view of a fence stay.
Figure 3:
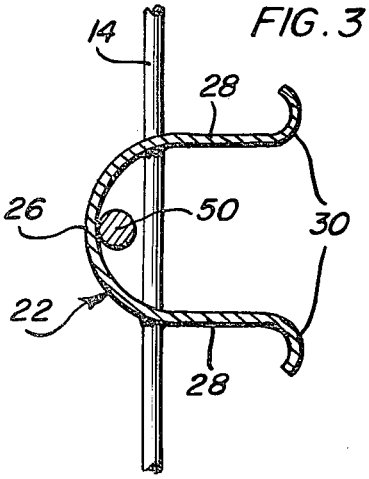
FIG. 3 is a sectional view taken along lines 3—3 of FIG. 1.
Figure 5:
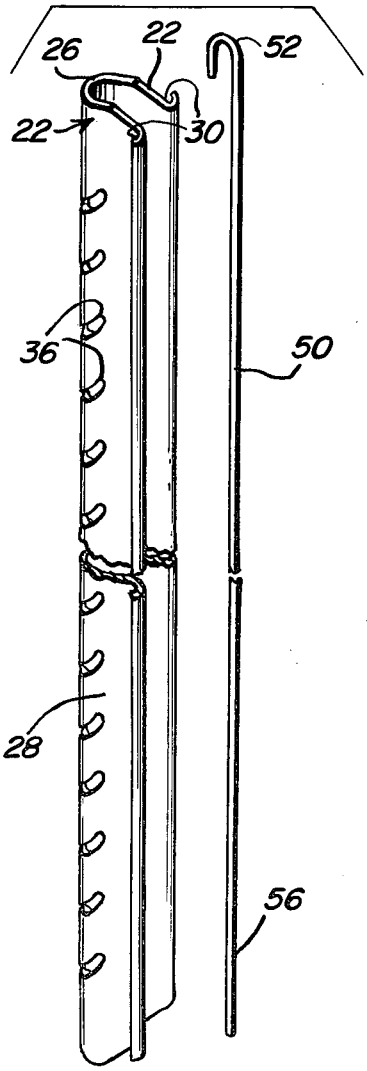
FIG. 5 is a perspective view of the elements forming the fence stay and the stay lock of the invention.

Referring now to the drawings, there is shown a plurality of aligned fence posts 10 having their lower ends inserted into the ground 12 and supporting a series of generally parallel wire strands 14 to form a conventional fence. One or more fence stays 20 of the present invention are connected to the wire strands 14 between the posts and each fence stay is constructed of an elongated strip 22 of generally rigid sheet material of generally U-shaped cross-sectional configuration with an arcuately curved bight portion 26 and slightly diverging leg portion 28 having the free vertical edges rolled outwardly as at 30 to provide additional rigidity to the structure of the fence stay 20 and the ends of the legs 28 are partially bevelled as at 32.

Figure 4:
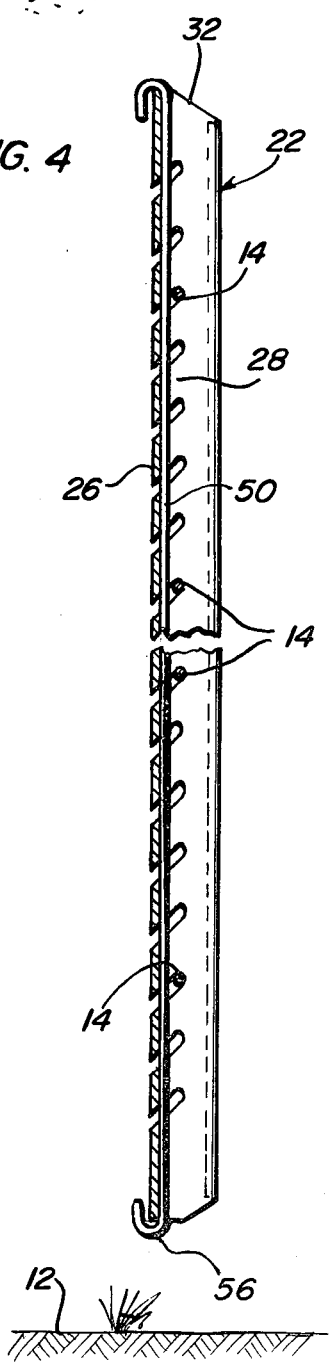
FIG. 4 is a sectional view taken along lines 4—4 of FIG. 1.

The bight portion 26 and portions of the leg portions 28 include a series of angularly oriented notches or slots 36 oriented in equally spaced parallel relation and inclined downwardly when installing the fence stay 20 on the wire strands 14 so that the stay 20 is held by the wire strands 14 to facilitate installation of the stays as the stay is maintained on the wire strands 14 due to the gravity. A stay lock in the form of a wire 50 is inserted between the inner surface of the bight portion 26 of the stay 20 and the wire strands 14 received in slots 36 to retain the wire strands 14 in the slots 36. The wire 50 has a hook 52 at the upper end which engages the top edge of the bight portion 26 and after installation of the wire 50, the lower end is crimped around the lower end of the bight portion 26 as indicated by numeral 56 in FIG. 4. The wire 50 is easily and readily inserted in the space between the wire strands 14 and the interior surface of the stay adjacent the bight portion 26. After the wire lock 50 has been inserted for the full length of the fence stay 20, the lower end 56 is bent upwardly to lock the stay lock wire 50 onto the fence stay 20 and thus secure the wire strands 14 securely within the fence stay.

Peripheral surfaces of the fence stay are coated with a reflective coating material, or the entire surface of the fence stay 20 can be coated with a reflective coating so that it is easily and readily seen by both man and animal resulting in improved livestock and security fencing that is safer than fence stays of the prior art.

The fence stays 20 are constructed of a sheet material of metal and may be coated with a material that withstands weather damage for use in areas of the sunbelt, and the fence stays may be constructed of sheet plastic materials that are found to last longer in high rainfall areas. Sheet material of plastic can be used for constructing the fence stays to separate electrically charged strands 14 of fencing from non-insulated strands in the same electric fence line thus reducing the possibility of the non-insulated strands "shorting" the insulated strands. The stays 20 may be constructed of any desired length and the configuration of the stays enables them to be compactly nested for storage and shipment and facilitates carrying a plurality of stays along a fence line when installing the stays. The wire 50 may be 14 or 16 gauge and can be easily cut to length and the hook 52 and crimp 56 can be easily formed by readily available hand tools such as pliers, wire cutters and the like. The slots may be spaced 2 inches apart so that the wires can be easily spaced even though the spacing between wire strands 14 where they attach to posts 10 may vary.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fence stay for use in fixedly spacing strands of any kinds of wire fencing includng smooth, barbed and woven wire strung between posts, the fence stay comprising an elongated strip of rigid sheet material having a pair of angularly related leg portions terminating in rolled edges lying in a first plane intersecting said leg portions, and a bight portion connecting the leg portions, a series of longitudinally spaced, transversely arranged slots along the length of the strip, said slots being open to the bight portion of the strip for receiving strands of wire fencing, the slots being inclined upwardly and inwardly from the bight portion and terminating in a second plane intersecting the legs and located between the bight portion and said first plane of the rolled edges of the strip and being spaced about 2 inches apart along the length of the strip to facilitate placing wires in selected slots at a desired spacing of the wires and means including a length of wire attached to and extending along the length of the strip inwardly of the open portion of the slots and outwardly of the wire strands for retaining the wire strands in the slots.

2. The fence stay arrangement of claim 1 wherein each end of the wire is crimped over an end of the strip for securably retaining the wire on the strip.

3. The fence stay arrangement of claim 1 wherein a reflective coating is applied to the exterior contours of the fence stay providing increased awareness of a presence of the fence stay.

4. The fence stay arrangement of claim 1 wherein the strip is made of sheet metal for longer lasting use to reduce weather damage in a sunlight environment and the strip is made of sheet plastic for longer lasting use to reduce weather damage in a high rainfall environment.

5. The fence stay arrangement of claim 1 wherein the strip is constructed of electrical insulation material for use as fence stays and for spacing insulated electrically charged wire strands from non-insulated strands in the same fence.

6. The fence stay arrangement of claim 1 wherein the strip material is lightweight, and the spaced slots are inclined upwardly and inwardly for augmenting the locking effect of the fence stay.

7. In combination with a fence having a series of wires strung between fence posts, a fence stay suspended on the wires between the posts to maintain the inter-wire spacing, the stay comprising an elongated strip of rigid sheet material having a pair of angularly related leg portions terminating in rolled edges lying in a first plane intersecting said leg portions, and a bight portion connecting the leg portions, a series of longitudinally spaced, transversely arranged slots along the length of the strip in excess of the number of fence wires, selected ones of the slots receiving the respective fence wires so as to maintain a desired spacing between the wires, said slots being open to the bight portion of the strip, being inclined upwardly and inwardly from the bight portion, and terminating in a second plane intersecting the legs and located between the bight portion and said first plane of the rolled edges of the strip, whereby the fence wires are free from contact with said edges, and a locking wire retaining the fence wires in the respective slots, the locking wire extending lengthwise along the inner surface of the bight portion of the strip between said surface and the fence wires with clearance between the locking wire and the fence wires, and the locking wire being crimped to the strip at least at one end for retaining the fence wires in the slots.

8. The combination of claim 7 wherein the locking wire is crimped over both ends of the strip and the lower end of the strip is free of contact with the ground.

9. The combination of claim 7 wherein the slots are spaced at intervals of about 2 inches along the length of the strip.

* * * * *